US008968116B1

(12) United States Patent
Myers et al.

(10) Patent No.: US 8,968,116 B1
(45) Date of Patent: Mar. 3, 2015

(54) GOLF CLUB HEAD WITH ADJUSTABLE CHARACTERISTICS

(71) Applicant: Callaway Golf Company, Carlsbad, CA (US)

(72) Inventors: Matthew Myers, Carlsbad, CA (US); Wayne H. Byrne, Murietta, CA (US); Larry Tang, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/326,307

(22) Filed: Jul. 8, 2014

Related U.S. Application Data

(63) Continuation-in-part of application No. 13/766,658, filed on Feb. 13, 2013, now Pat. No. 8,790,195.

(60) Provisional application No. 61/746,348, filed on Dec. 27, 2012.

(51) Int. Cl.
*A63B 53/06* (2006.01)
*A63B 53/04* (2006.01)

(52) U.S. Cl.
CPC ..... *A63B 53/06* (2013.01); *A63B 53/0466* (2013.01); *A63B 2053/0491* (2013.01); *A63B 2053/0495* (2013.01); *A63B 2053/0433* (2013.01)
USPC ..... 473/338; 473/334; 473/335; 473/336; 473/341

(58) Field of Classification Search
CPC ..... A63B 2053/0491; A63B 253/0495; A63B 2053/0433; A63B 53/06
USPC ..... 473/334–339, 341
See application file for complete search history.

(56) References Cited

U.S. PATENT DOCUMENTS

| | | | | |
|---|---|---|---|---|
| 5,916,042 | A * | 6/1999 | Reimers | 473/334 |
| 6,089,994 | A * | 7/2000 | Sun | 473/338 |
| 7,108,609 | B2 * | 9/2006 | Stites et al. | 473/256 |
| 7,166,041 | B2 * | 1/2007 | Evans | 473/334 |
| 8,790,195 | B1 * | 7/2014 | Myers et al. | 473/338 |
| 2005/0148405 | A1 * | 7/2005 | Imamoto | 473/338 |
| 2006/0240907 | A1 * | 10/2006 | Latiri | 473/334 |
| 2010/0331103 | A1 * | 12/2010 | Takahashi et al. | 473/338 |
| 2012/0122601 | A1 * | 5/2012 | Beach et al. | 473/248 |

FOREIGN PATENT DOCUMENTS

GB 2327889 A * 2/1999

* cited by examiner

*Primary Examiner* — Benjamin Layno
(74) *Attorney, Agent, or Firm* — Rebecca Hanovice; Michael A. Catania; Sonia Lari

(57) ABSTRACT

A golf club head with means for adjusting a center of gravity along more than one axis and means adjusting at least one of a characteristic selected from the group consisting of face angle, loft angle, and lie angle is disclosed herein. The golf club head comprises one or more adjustable features such as weight bars, weight screws, weight cartridges, and adjustable sole members, and preferably includes structural features such as pegs, teeth, and polymeric dampeners that serve to preload the one or more adjustable features on the golf club head and prevent or reduce unwanted vibrations when the golf club head is in use.

17 Claims, 8 Drawing Sheets

GOLF CLUB HEAD WITH ADJUSTABLE CHARACTERISTICS

The present application is a continuation-in-part of U.S. patent application Ser. No. 13/766,658, filed on Feb. 13, 2013, now U.S. Pat. No. 8,790,195, which claims priority to U.S. Provisional Patent No. 61/746,348, filed on Dec. 27, 2012, the disclosure of each of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of adjustable features that allow the club head's center of gravity to be moved along multiple axes.

2. Description of the Related Art

The ability to adjust center of gravity location and weight in the head of golf clubs is useful for controlling performance of the golf club, particularly in wood-type golf clubs such as drivers. The prior art includes several different solutions for adjustable weighting, but these solutions do not optimize weight adjustment because they typically allow for center of gravity (CG) adjustment along only one axis. See, for example, U.S. Pat. Nos. 7,611,424 and 8,016,694. Therefore, there is a need for a weighting mechanism that allows for simple and flexible center of gravity and moment of inertia (MOI) adjustability along more than one axis.

BRIEF SUMMARY OF THE INVENTION

The present invention is a novel way of working with adjustable products. The present invention allows consumers to adjust the center of gravity of a golf club head along both vertical and horizontal axes. The objective of this invention is to provide a plurality of adjustable weights with minimal or no effect on appearance at address while maximizing the ability of the weight to adjust center of gravity height. Additional goals include adjusting a loft, lie, and/or face angle of the golf club head.

Yet another aspect of the present invention is a golf club head comprising a body comprising a face, a sole, and a hosel, means for adjusting a center of gravity along a horizontal axis, means for adjusting the center of gravity along a vertical axis, and means for adjusting at least one of a characteristic selected from the group consisting of face angle, loft angle, and lie angle.

Another aspect of the present invention is a golf club head comprising a body comprising a face, a crown, a sole, an interior cavity, and a hosel, at least one weight bar comprising a first end, a second end, and a first plurality of holes disposed in the first end, and a sole member comprising a lower surface and a plurality of pegs extending from the lower surface, each of the plurality of pegs sized to fit within the plurality of holes, wherein the sole member removably affixes the first end of the at least one weight bar to the sole when one or more of the plurality of pegs is engaged with one or more of the first plurality of holes. In some embodiments, the sole member may comprise a first setting having a first height, a second setting having a second height, and a third setting having a third height, the first height may be greater than the second height, and the second height may be greater than the third height. In other embodiments, the at least one weight bar may comprise a polymeric material, which may be co-molded over at least a portion of an exterior surface of the at least one weight bar.

In some embodiments, the golf club head may further comprise a weight port and a weight screw sized to fit within the weight port. In such embodiments, the sole member may comprise a through bore sized to receive the weight screw, a portion of the weight screw may extend through the through bore, and the sole member may be disposed between the at least one weight bar and a portion of the weight screw when the weight screw is fully engaged with the weight port. In other embodiments, the at least one weight bar may comprise first and second weight bars. In some embodiments, the at least one weight bar may have a shape selected from the group consisting of rectangular and T-shaped. In other embodiments, the at least one weight bar may be composed of more than one material.

In one embodiment, the second end of the at least one weight bar may be a separate, removable piece. In a further embodiment, the first end of the at least one weight bar may be composed of a first material having a first density, the second end of the at least one weight bar may be composed of a second material having a second density, and the second density may be greater than the first density.

In another embodiment, the golf club head of claim may further comprise a guide ring, and at least a portion of the at least one weight bar may hook over the guide ring. In a further embodiment, the guide ring may comprise a second plurality of holes disposed in an upper surface of the guide ring, the first plurality of holes may extend completely through the first end of the at least one weight bar, the second plurality of holes may line up with the first plurality of holes, the second plurality of holes may line up with the plurality of pegs, and one or more of the plurality of pegs may be engaged with one or more of the second plurality of holes when the one or more of the plurality of pegs is engaged with one or more of the first plurality of holes. In some embodiments, the guide ring may comprise a plurality of teeth extending from a lower surface of the guide ring, the at least one weight bar may comprise a plurality of prongs, and the plurality of prongs may engage at least one of the plurality of teeth when the at least one weight bar is hooked over the guide ring.

In other embodiments, the sole may comprise a recessed region, and each of the guide ring, the sole member, and the at least one weight bar may be disposed within the recessed region. In a further embodiment, the golf club head may further comprise a hollow tube extending through the interior cavity between the crown and the sole. In this embodiment, the hollow tube may protrude from the recessed region, the guide ring may comprise a first through bore, the sole member may comprise a second through bore, and the hollow tube may extend through the first and second through bores. In yet another, further embodiment, the golf club head may further comprise a weight cartridge sized to fit within the hollow tube, and may also comprise a cap sized to retain the weight cartridge within the hollow tube. The cap may also retain the sole member on the sole.

Another aspect of the present invention is a golf club head comprising a body comprising a face, a crown, a sole, and a hosel, at least one weight bar comprising a first end, a second end, and a plurality of prongs extending from an underside of the second end, and a guide ring comprising a lower surface and a plurality of teeth extending from the lower surface, wherein at least a portion of the at least one weight bar hooks over the guide ring, and wherein the plurality of prongs engages at least one of the plurality of teeth. In some embodiments, the golf club head may further comprise a weight port in the sole and a removable weight member, and the removable weight member may retain the at least one weight bar and the guide ring on the sole when the removable weight member is engaged with the weight port. In another embodiment, the second end of the at least one weight bar may be a separate, removable piece.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
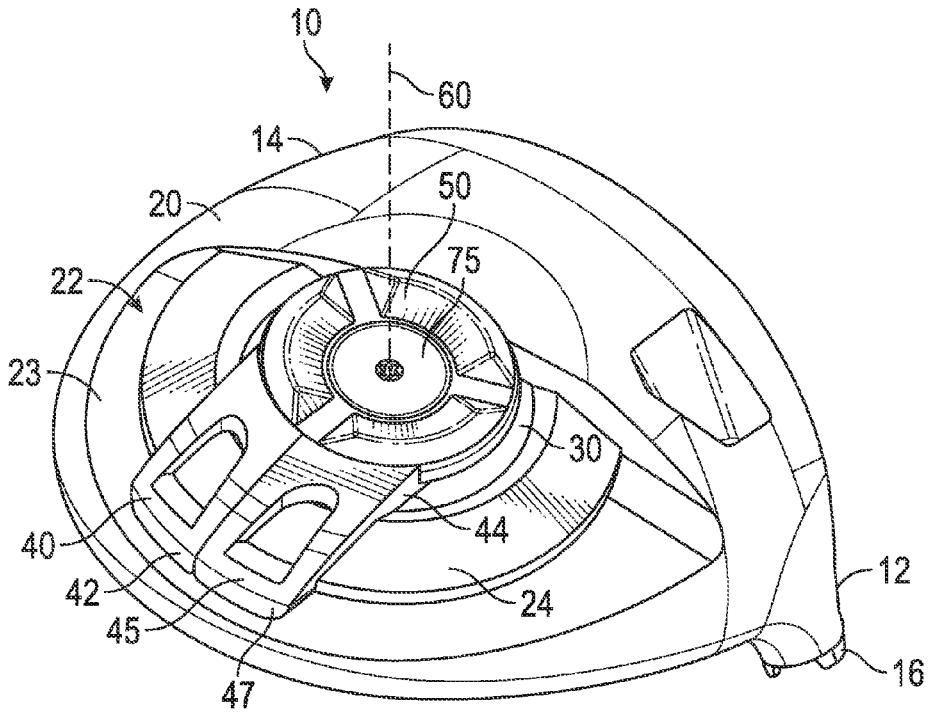
FIG. 1 is a sole perspective view of a golf club head encompassing a first embodiment of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup, and particularly with a skeletal metal/composite structure such as the one disclosed in U.S. patent application Ser. No. 14/162,633, the disclosure of which is hereby incorporated by reference in its entirety herein. The weighting embodiments disclosed herein will also work in conjunction with at least one adjustable weight port on the crown of the driver head. Shifting weight as described herein allows for control of center of gravity location, and adjusting the adjustable sole member allows for adjustment of characteristics such as face angle, loft, and/or lie.

A preferred embodiment of the present invention is shown in FIGS. 1-5 and 9. The golf club head 10 comprises a crown 18, a sole 20, a face (not shown), a heel 12, a toe 14, and a hosel 16. The sole 20 comprises a recessed region 22 located at least 0.25 inch away from the face with a raised, partial ring 24 extending perpendicularly away from the base 23 of the recessed region 22. The ring 24 at least partially encircles a recess 30 located in a central region of the sole 20 and is composed of a lightweight material such as composite, aluminum, stainless steel, or titanium alloy. The recess 30 is sized to receive first end regions 41, 46 of at least two weight bars 40, 45 and an adjustable sole member 50, all of which are rotatable around a central axis 60 intersecting the midpoint of the recess 30. The recess 30 also comprises, at its midpoint, a threaded weight port 70 sized to receive a removable fastener, which preferably is a weight screw 75 having a lip portion 76, a body 77, and a threaded region 78.

Figure 2:
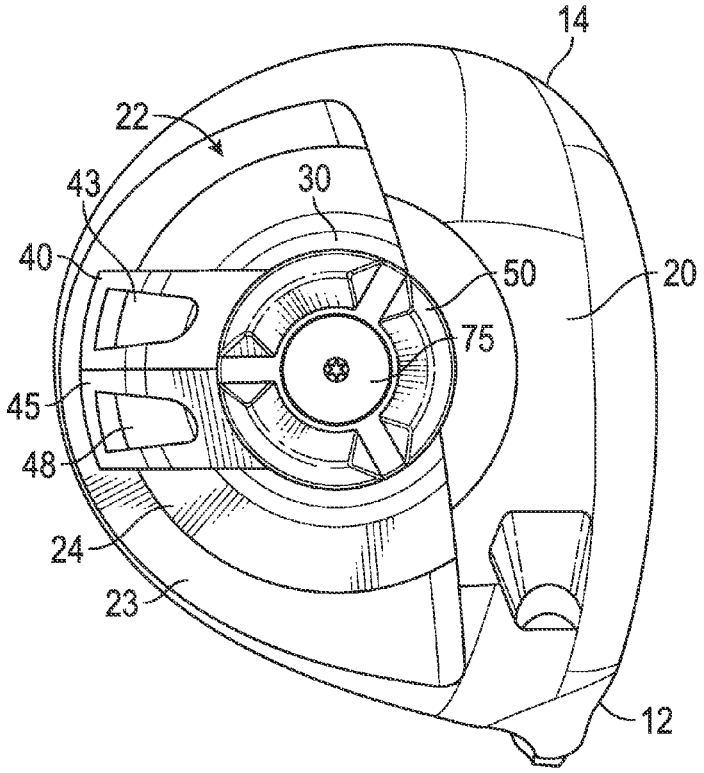
FIG. 2 is a sole plan view of the embodiment shown in FIG. 1.
Figure 3:
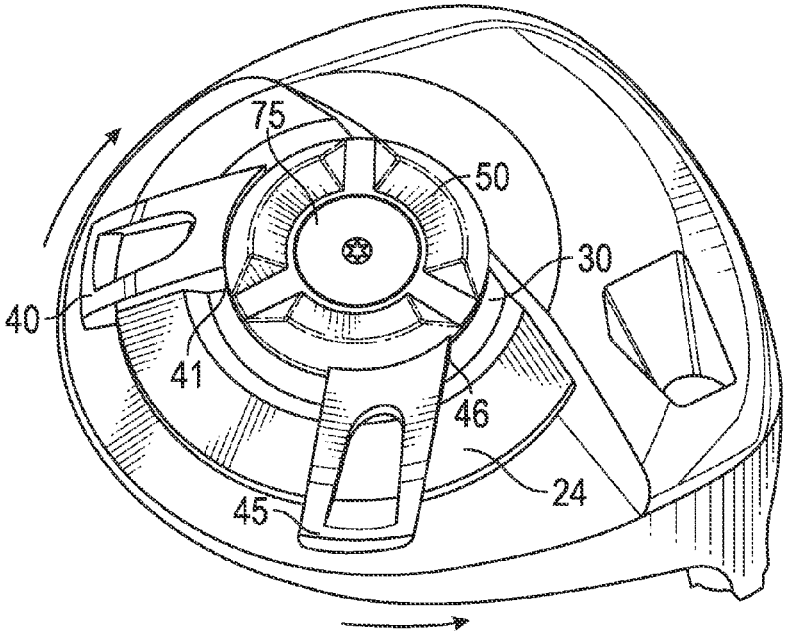
FIG. 3 is a sole perspective view of the embodiment shown in FIG. 1 with a different weight configuration.
Figure 4:
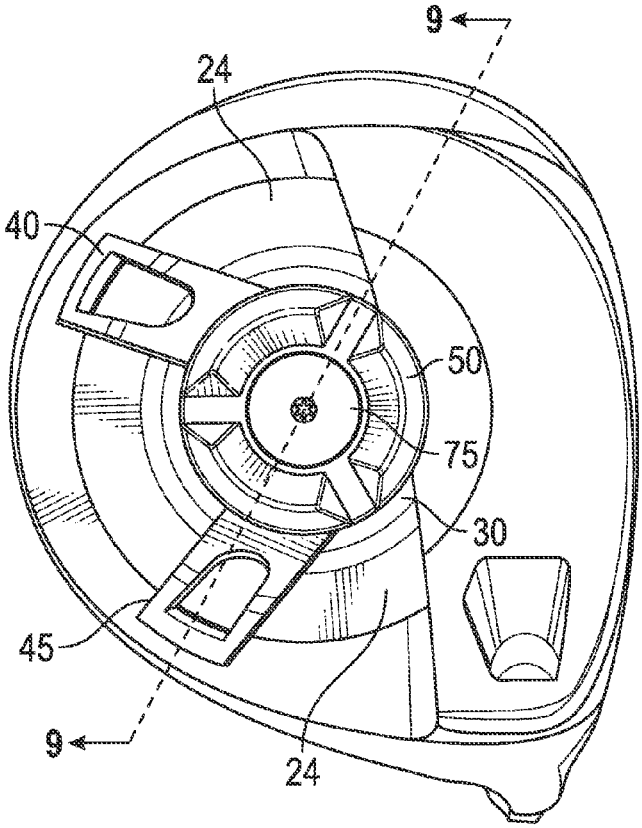
FIG. 4 is a sole plan view of the embodiment shown in FIG. 3.
Figure 5:
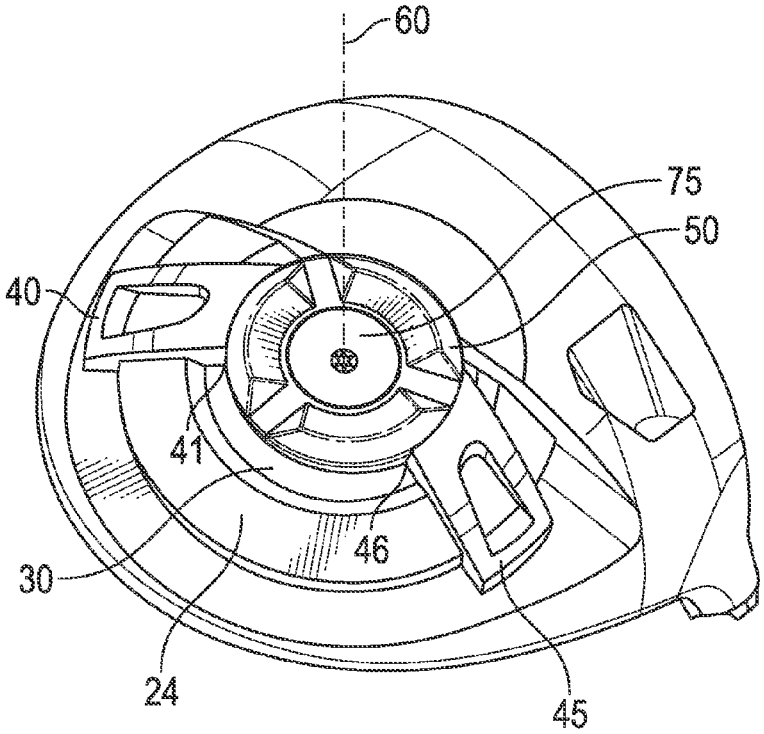
FIG. 5 is a sole perspective view of the embodiment shown in FIG. 1 with another weight configuration.

The preferred embodiment of the present invention allows for adjustment of multiple characteristics of the golf club head 10. As shown in FIGS. 1-5, when the weight screw 75 or other fastener is loosened, and the adjustable sole member 50 is not pressing their first end regions 41, 46, against the sole 20 of the golf club head 10, the weight bars 40, 45 are free to be rotated around the central axis 60 by sliding their second end regions 42, 47 along the recessed region 22 towards the heel 12 and/or toe 14 regions of the golf club head 10. FIGS. 1, 3, and 5 show several configurations of the weight bars 40, 45 on the golf club head 10 of the present invention. Adjusting the weight bars 40, 45 in this manner allows for horizontal adjustment of the golf club's center of gravity location, and also affects face angle. For example, moving the weight bars 40, 45 towards the toe 14 creates a fade effect, moving the weight bars towards the heel 12 creates a draw effect, and centering the weight bars 40, 45 such that they are disposed approximately perpendicular to the face, as shown in FIGS. 1 and 2, creates a neutral effect.

Figure 16:
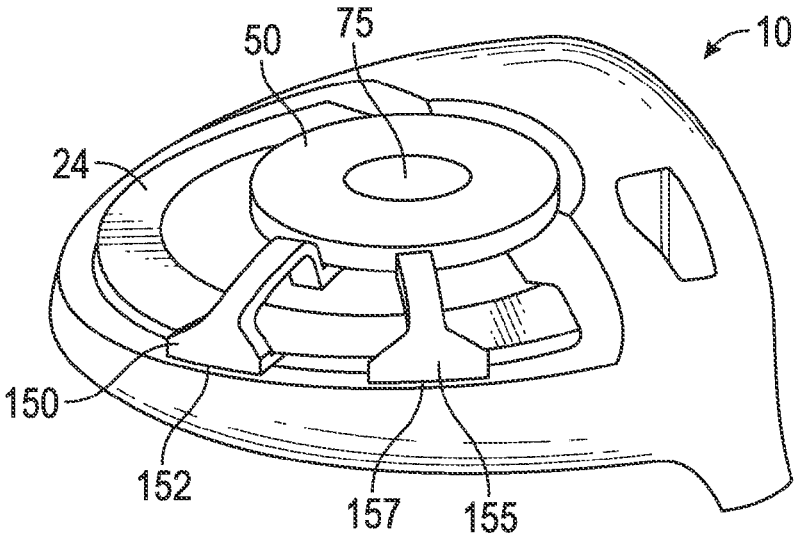
FIG. 16 is a perspective view of another embodiment of the invention.

The weight bars 40, 45 preferably have one or more gaps or openings 43, 48 to ensure that more mass is disposed at the second end regions 42, 47 of the weight bars 40, 45, so that moving the weight bars 40, 45 within the recessed region 22 has a greater effect on the location of the golf club head's 10 center of gravity. These openings 43, 48 may be filled with secondary weights (not shown) to further affect the weight distribution of the weight bars 40, 45. In an alternative embodiment, shown in FIG. 16, the weight bars 150, 155 may be T-shaped so that even more mass is moved to the second end regions 152, 157. In the preferred embodiment, as in the alternative embodiments disclosed herein, the second end regions 42, 47 of the weight bars preferably hook over the sides of the ring 24 as shown in FIGS. 1, 3, 5, and 9 to provide greater engagement between the sole 20 and the weight bars 40, 45. In this way, the ring 24 acts as a rail that guides the weight bars 40, 45 as they are moved along the sole 20.

Figure 17:
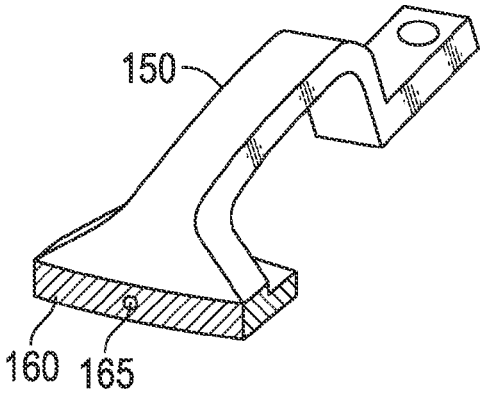
FIG. 17 is an enlarged, perspective view of an alternative weight bar of the present invention.

The weight bars 40, 45 may be made of any material known to a person of ordinary skill in the art, but preferably are made of multiple materials such that the second end regions 42, 47 are formed from denser material than the first end regions 41, 46. In the preferred embodiment, the second end regions 42, 47 are formed from a tungsten alloy, while the first end regions 41, 46 are formed from an aluminum, titanium, or stainless steel alloy. In another embodiment, the second end regions 42, 47 are detachable from the first end regions 41, 46, such that they can be swapped out for other second end regions 42, 47 having different dimensions and/or mass properties. For example, as shown in FIG. 17, a weight bar 150 having a different shape than the ones shown in FIGS. 1-5 has a removable cap 160 that is affixed to the weight bar 150 with a screw 165 (or other type of mechanical fastener). The cap 160 can be removed and replaced with a different cap 160 having a different density, material composition, and/or shape to further adjust the mass properties of the golf club head 10.

Figure 6:
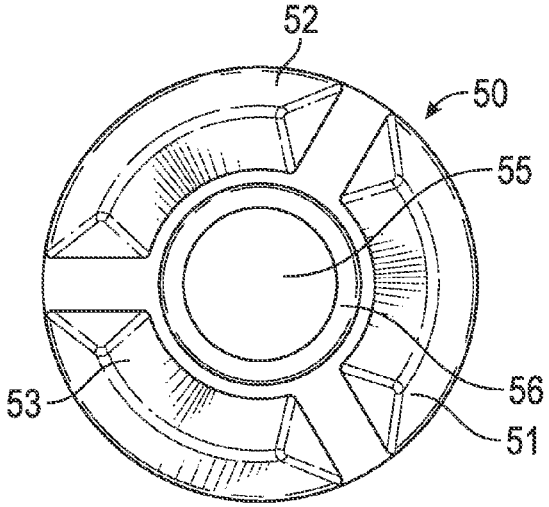
FIG. 6 is bottom plan view of the adjustable sole member shown in FIG. 1.
Figure 7:
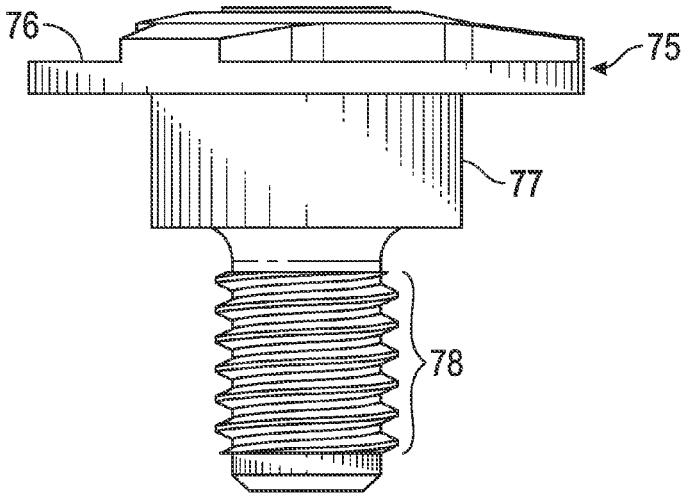
FIG. 7 is a side perspective view of the weight screw shown in FIG. 1.

When the weight screw 75 or other fastener is loosened, the adjustable sole member 50 also can be rotated around the central axis. As shown in FIG. 6, the adjustable sole member 50 has a central bore 55 sized to receive the weight screw 75 and a lower ledge 56 against which a lip portion 76 of the weight screw 75 can rest. The adjustable sole member 50 also has at least three settings, open 51, closed 52, and neutral 53, which change the face angle of the golf club head 10 when it is at address. The adjustable sole member 50 preferably functions in the same manner as the adjustable keel member disclosed in U.S. Pat. No. 7,934,999, the relevant disclosure of which is hereby incorporated by reference herein, wherein each setting (also known as an apex point) has a different height. The adjustable sole member 50 preferably is circular, but in other embodiments may be triangular or have another polygonal shape. The adjustable sole member 50 preferably is composed of a lightweight material such as aluminum alloy, plastic, or composite, or a combination of such materials, but in alternative embodiments may be made of any material known to a person of ordinary skill in the art.

The weight screw 75, which serves to removably but securely affix the adjustable sole member 50 and weight bars 40, 45 to the sole 20 in configurations selected by a user, may have any of the characteristics or features of any of the embodiments disclosed in U.S. patent application Ser. No. 13/410,127, U.S. patent application Ser. No. 13/412,395, U.S. patent application Ser. No. 13,754,373, and/or U.S. Provisional Patent Application No. 61/705,498, the disclosure of each of which is hereby incorporated by reference in its entirety herein. In the preferred embodiment, the golf club head 10 is provided with multiple weight screws 75 having different compositions and/or densities, such that the user can adjust the vertical location of the golf club head 10 center of gravity by replacing one weight screw 75 with another weight screw 75 having a different density.

Figure 8:
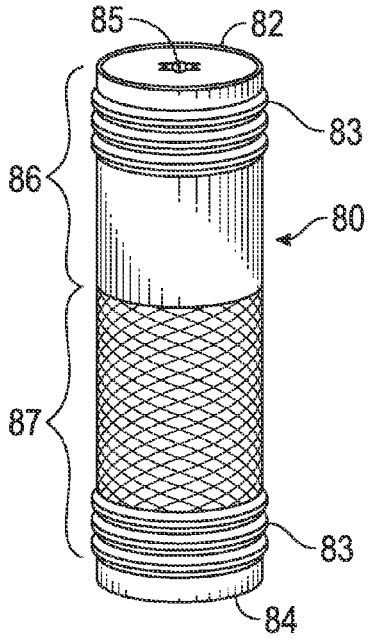
FIG. 8 is a side perspective view of a weight cylinder provided in an alternative embodiment of FIG. 1.
Figure 9:
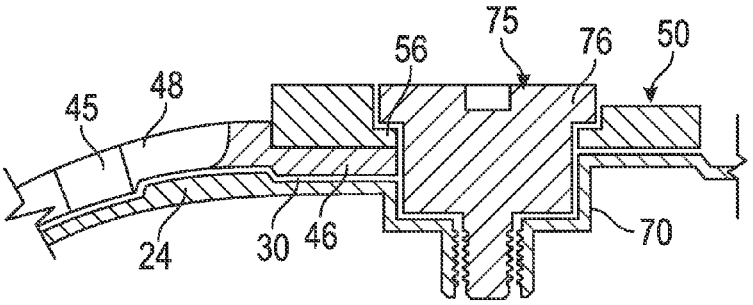
FIG. 9 is a cross-sectional view of the embodiment shown in FIG. 4 along lines 9-9.
Figure 10:
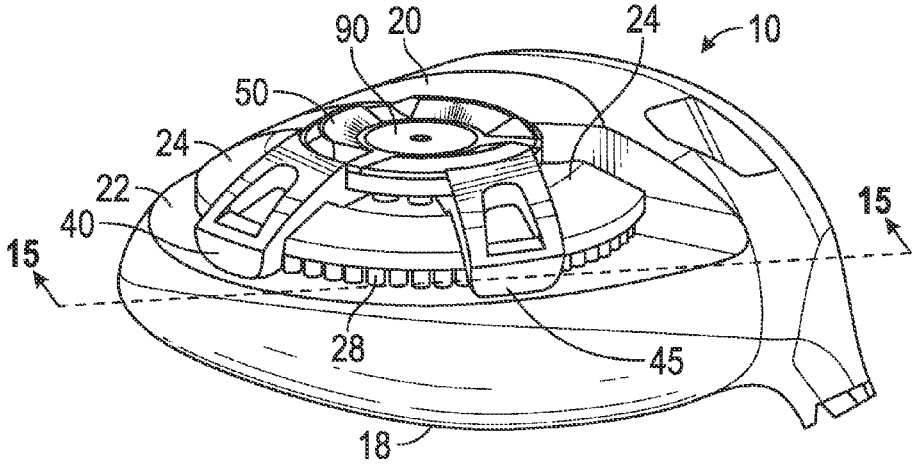
FIG. 10 is a perspective view of another embodiment of the invention.

In an alternative embodiment, a weight cartridge 80, such as the one shown in FIG. 8, is used instead of a weight screw 75. In this embodiment, the weight port 70 is elongated into a tube sized to receive the weight cartridge 80. The tube may extend from the sole 20 and make contact with the crown or another part of the golf club head 10 (the heel 12 or the toe 14, for instance), or it may be suspended within an interior cavity of the golf club head 10. As shown in FIG. 8, the weight cartridge 80 may be cylindrical, and preferably has a first region 86 formed from a denser material or combination of materials than a second region 87. In this embodiment, when a first end 82 of the weight cartridge 80 is inserted into the weight port 70, such that the second end 84 is disposed proximate the sole 20, the vertical center of gravity of the golf club head 10 differs from when the second end 84 of the weight cartridge 80 is inserted into the weight port 70 such that the first end 82 is disposed proximate the sole 20. In other words, removing, inverting, and then reinserting the weight cartridge 80 into the weight port 70 alters the vertical location of the golf club head 10 center of gravity.

Each end 82, 84 of the weight cartridge 80 also preferably includes external threads 83 and an opening 85 sized to receive an adjustment tool such as a hex wrench or screwdriver, such that the weight cartridge 80 can be removably secured within the weight port 70. In an alternative embodiment, another method of securing the weight cartridge 80 within the weight port 70 may be used, such as a cap 90 or clip features or any other means known to a person skilled in the art. A cap 90 is particularly useful because it can also be used to secure the adjustable sole member 50 to the sole 20. In each of the alternative embodiments employing a weight cartridge 80, the weight cartridge 80 and the weight port 70 or tube may have any of the features or characteristics of the embodiments disclosed in U.S. patent application Ser. Nos. 14/039,102 and 14/159,262, the disclosure of each of which is hereby incorporated in its entirety herein.

In another embodiment, the weight screw 75 (or weight cartridge 80 assembly) is not the only feature that is used to secure the adjustable sole member 50 to the recessed region 22 of the sole, and thus reversibly fix the weight bars 40, 45 to desired positions on the ring 24 and the recessed region 22 of the sole 20. When just a weight screw 75 or other similar feature is used to secure all of the pieces of the present invention together at a single point on the recessed region 22 of the sole 20, the adjustable features, including the weight bars 40, 45 and adjustable sole member 50, may rattle or even come loose during use. The pressure exerted by the weight screw 75 may not be sufficient to hold everything in place under the stressful conditions placed on the golf club head 10 when it makes contact with a golf ball at high speeds. This can be mitigated by co-molding a polymer material such as plastic or rubber over some or all of these pieces and/or over the ring 24, or by placing a polymeric washer underneath each of these pieces where they make contact with the recessed region 22 of the sole 20.

Alternatively, or in addition to these dampening features, the structures shown in FIGS. 10-15 provides a secure means of preventing movement of the adjustment pieces and unwanted noise when the golf club head 10 is in play. In this embodiment, a weight cartridge 80 and cap 90 provide vertical center of gravity adjustability for the head, which includes a tube 95 sized to receive the weight cartridge 80 and including threads to mate with threads on the cap 90. The cap 90 or, in an alternative embodiment, a weight screw 75, presses against a lower ledge 56 of the adjustable sole member 50 to keep it from disengaging from the rest of the golf club head 10 when fully assembled. The tube 95 projects from the recessed region 22 of the sole 20 and is threaded through an opening 27 in the ring 24 and the central bore 55 in the center of the adjustable sole member 50 during assembly of the golf club head 10, thus helping to hold the pieces of the golf club head 10 together.

As shown in FIGS. 10-14, a plurality of pegs 57 extends perpendicularly from the bottom surface 58 of the adjustable sole member 50. Each of these pegs 57 is sized to fit within one of a plurality of holes 44, 49 located in the first end regions 41, 46 of the weight bars 40, 45. The ring 24 also comprises a plurality of holes 26 in its upper surface 25*a*, which receive the pegs 57 of the adjustable sole member 50 when it is assembled with the weight bars 40, 45 and the ring 24. The pegs 57 securely fix the first end regions 41, 46 of the weight bars 40, 45 to the ring 24 and the adjustable sole member 50 once a user selects the desired location of the weight bars 40, 45 on the recessed region 22 of the sole 20 and prevent them from moving during use. The pegs 57 on the adjustable sole member 50 preferably extend around its entire circumference and the holes 26 in the upper surface 25*a* of the ring 24 preferably extend entirely around the opening 27 so that the weight bars 40, 45 can be positioned at any point around the adjustable sole member 50, as desired by a golfer.

As shown in FIGS. 10-13 and 15, a plurality of teeth 28 extends perpendicularly from the bottom surface 25*b* of the ring 24 such that they abut the rounded edge of the ring 24. These teeth 28 are sized to mate with a pair of prongs 100 extending from an underside of the second end regions 42, 47 of each of the weight bars 40, 45 so that, when the weight bars 40, 45 are assembled with the ring 24, the golf club head 10, and the adjustable sole member 50, their second end regions 42, 47 do not move when the golf club head 10 is in use. When a golfer selects the desired location of the weight bars 40, 45, she slides the prongs 100 into the teeth at the desired location and then affixes the adjustable sole member 50 to the top of the weight bars 40, 45 so that the pegs 57 fit within the holes 44, 49 in the weight bars 40, 45 and the holes 26 in the upper surface 25*a* of the ring. In other words, the prongs 100, teeth 28, pegs 57 and holes 44, 49, 26 all serve to anchor the weight bars 40, 45 securely to the golf club head at locations selected by a golfer. These structures also serve to preload the pieces of the present invention, and particularly the weight bars 40, 45, on the recessed region 22 of the sole 20, to reduce or eliminate vibrations. Different types of structures may also be used to preload the weight bars 40, 45 and still be consistent with the spirit of this invention.

For each of the embodiments disclosed herein, the weight bars 40, 45, 150, 155 may be removed from the golf club head 10 and replaced with weight bars 40, 45, 150, 155 having different shapes, material compositions, and/or densities. Similarly, weight bars 40, 45, 150, 155 held on a single golf club head 10 may be removed and placed at different locations on the sole (e.g., swapped with each other) to adjust the mass properties of the golf club head 10. In each embodiment, the weight bars 40, 45, 150, 155 preferably are preloaded to eliminate or reduce unwanted vibrations when the golf club head 10 is in use.

Figure 11:
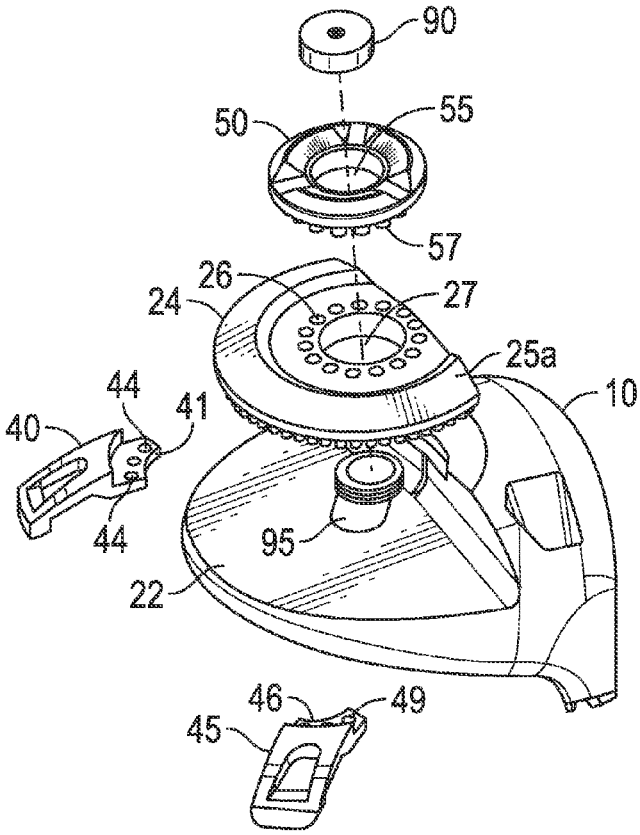
FIG. 11 is a top-side, exploded view of the embodiment shown in FIG. 10.
Figure 12:
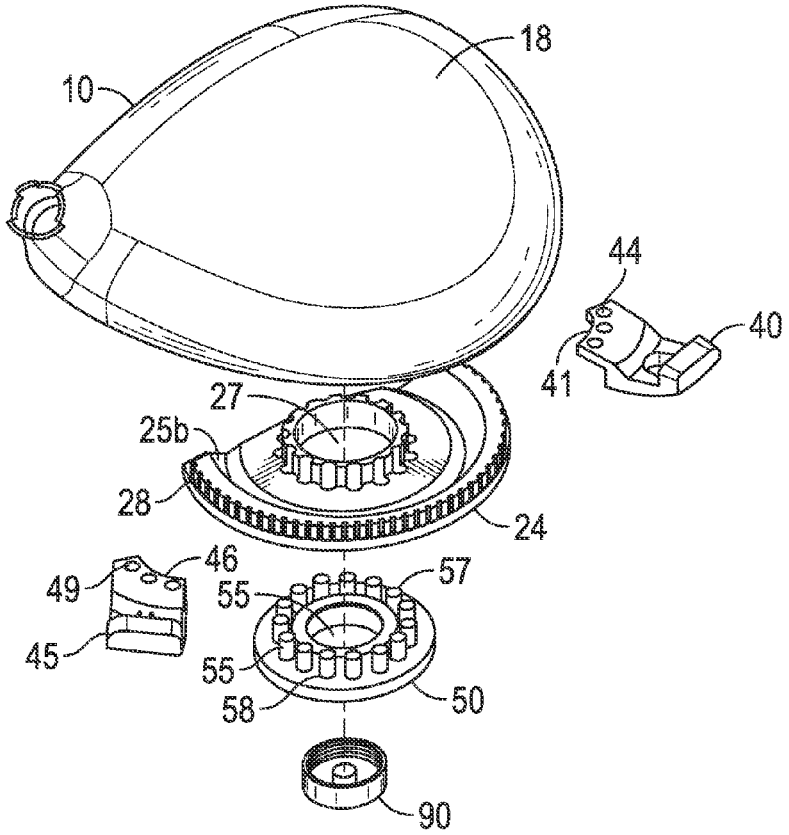
FIG. 12 is a bottom-side, exploded view of the embodiment shown in FIG. 10.
Figure 13:
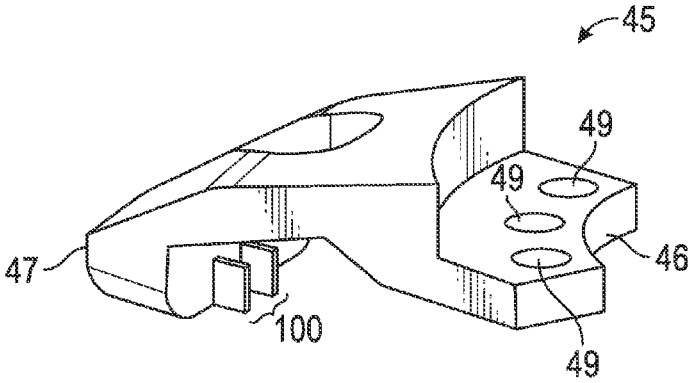
FIG. 13 is an enlarged, perspective view of a weight bar shown in FIG. 10.
Figure 14:
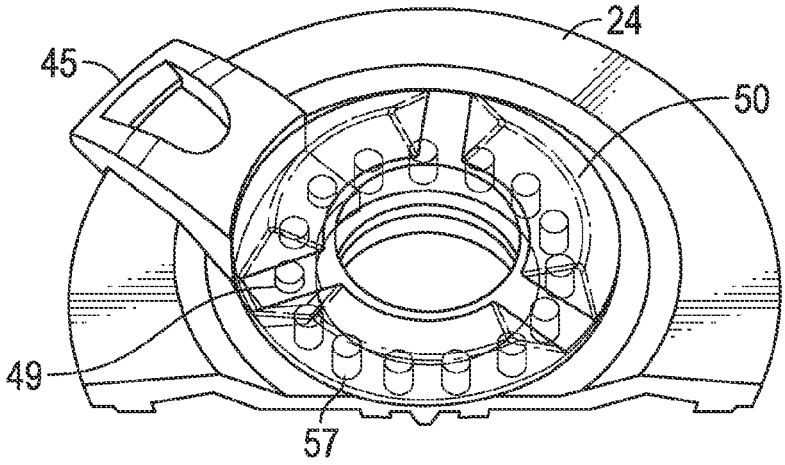
FIG. 14 is a perspective, partially translucent view of the adjustable sole member, weight bar, and ring shown in FIG. 10.
Figure 15:
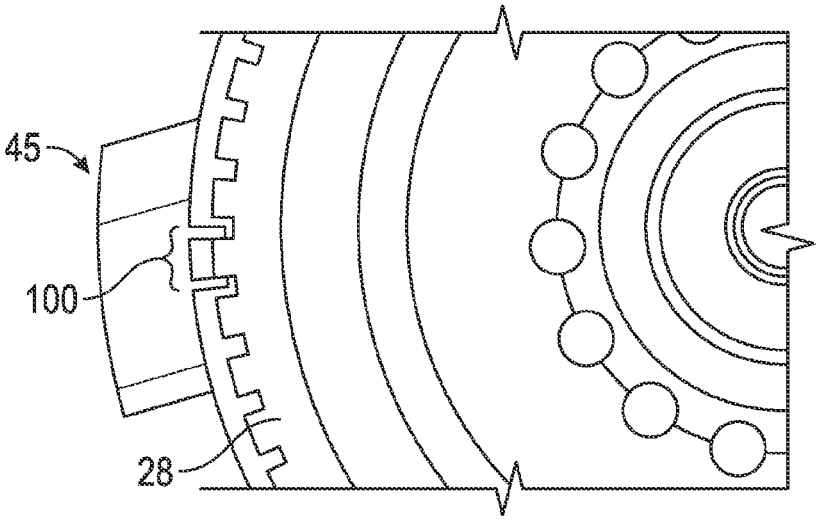
FIG. 15 is a cross-sectional view of the embodiment shown in FIG. 10 along lines 15-15.

Though the ring 24 is shown in FIGS. 11 and 12 as being a separate piece that is removable from the golf club head 10, in an alternative embodiment it may be integrally formed with, or permanently affixed to, the recessed region 22 of the sole 20.

The golf club head 10 of the present invention also preferably includes an adjustable hosel assembly, such that loft, lie, and/or face angle can be changed by adjusting the position of a shaft (not shown) with respect to the hosel 16. The golf club head 10 may have any of the adjustable hosel assembly embodiments disclosed in U.S. patent application Ser. Nos. 13/311,319, 13/436,512, 13/368,569, 13/439,664, 13/367,045, 13/326,156, 13/332,846, 13/408,018, 13/544,037, and 13/660,882, the disclosure of each of which is hereby incorporated by reference in its entirety herein, or in U.S. Pat. Nos. 7,083,529, 7,427,239, 7,465,239, 7,578,749, 8,002,644, 8,096,895, 8,235,840, 8,257,193, the disclosure of each of which is hereby incorporated by reference in its entirety herein.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated by reference in its entirety herein.

Each of the disclosures of U.S. Pat. Nos. 7,934,999, 8,012,034, 8,123,626, 8,221,258, and 8,262,496 to Cackett et al. is hereby incorporated by reference in its entirety herein. The disclosure of U.S. Patent Application Publication Number 2011/0165961 is hereby incorporated by reference in its entirety herein. The disclosure of U.S. patent application Ser. No. 13/410,127 is hereby incorporated by reference in its entirety herein. The disclosure of U.S. Provisional Patent Application No. 61/684,079 is hereby incorporated by reference in its entirety herein. The disclosure of U.S. Provisional Patent Application No. 61/705,498 is hereby incorporated by reference in its entirety herein. The disclosure of U.S. Provisional Patent Application No. 61/727,608 is hereby incorporated by reference in its entirety herein. The disclosure of each of U.S. Pat. No. 7,147,573 to DiMarco and U.S. Pat. No. 7,166,041 to Evans is also hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face, a crown, a sole, an interior cavity, and a hosel;

at least one weight bar comprising a first end, a second end, and a first plurality of holes disposed in the first end; and a sole member comprising a lower surface and a plurality of pegs extending from the lower surface, each of the plurality of pegs sized to fit within the plurality of holes, wherein the sole member removably affixes the first end of the at least one weight bar to the sole when one or more of the plurality of pegs is engaged with one or more of the first plurality of holes.

2. The golf club head of claim 1, wherein the sole member comprises a first setting having a first height, a second setting having a second height, and a third setting having a third height, wherein the first height is greater than the second height and the second height is greater than the third height.

3. The golf club head of claim 1, wherein the at least one weight bar comprises a polymeric material, and wherein the polymeric material is co-molded over at least a portion of an exterior surface of the at least one weight bar.

4. The golf club head of claim 1, further comprising a weight port and a weight screw sized to fit within the weight port, wherein the sole member comprises a through bore sized to receive the weight screw, wherein a portion of the weight screw extends through the through bore, and wherein the sole member is disposed between the at least one weight bar and a portion of the weight screw when the weight screw is fully engaged with the weight port.

5. The golf club head of claim 1, wherein the at least one weight bar comprises first and second weight bars.

6. The golf club head of claim 1, wherein the at least one weight bar has a shape selected from the group consisting of rectangular and T-shaped.

7. The golf club head of claim 1, wherein the second end of the at least one weight bar is a separate, removable piece.

8. The golf club head of claim 7, wherein the first end of the at least one weight bar is composed of a first material having a first density, wherein the second end of the at least one weight bar is composed of a second material having a second density, and wherein the second density is greater than the first density.

9. The golf club head of claim 1, wherein the at least one weight bar is composed of more than one material.

10. The golf club head of claim 1, further comprising a guide ring, wherein at least a portion of the at least one weight bar hooks over the guide ring.

11. The golf club head of claim 10, wherein the guide ring comprises a second plurality of holes disposed in an upper surface of the guide ring, wherein the first plurality of holes extends completely through the first end of the at least one weight bar, wherein the second plurality of holes lines up with the first plurality of holes, wherein the second plurality of holes lines up with the plurality of pegs, and wherein one or more of the plurality of pegs is engaged with one or more of the second plurality of holes when the one or more of the plurality of pegs is engaged with one or more of the first plurality of holes.

12. The golf club head of claim 10, wherein the guide ring comprises a plurality of teeth extending from a lower surface of the guide ring, wherein the at least one weight bar comprises a plurality of prongs, and wherein the plurality of prongs engages at least one of the plurality of teeth when the at least one weight bar is hooked over the guide ring.

13. The golf club head of claim 10, wherein the sole comprises a recessed region, and wherein each of the guide ring, the sole member, and the at least one weight bar is disposed within the recessed region.

14. The golf club head of claim 13, further comprising a hollow tube extending through the interior cavity between the crown and the sole, wherein the hollow tube protrudes from the recessed region, wherein the guide ring comprises a first through bore, wherein the sole member comprises a second through bore, and wherein the hollow tube extends through the first and second through bores.

15. The golf club head of claim 14, further comprising a weight cartridge sized to fit within the hollow tube.

16. The golf club head of claim 15, further comprising a cap sized to retain the weight cartridge within the hollow tube.

17. The golf club head of claim 16, wherein the cap retains the sole member on the sole.

* * * * *